United States Patent [19]

Itoh

[11] Patent Number: 4,508,502

[45] Date of Patent: Apr. 2, 1985

[54] INFRARED GAS BURNER PLATE

[75] Inventor: Jiro Itoh, Nishi-Karaso, Japan

[73] Assignee: Rinnai Corporation, Nagoya, Japan

[21] Appl. No.: 492,323

[22] Filed: May 6, 1983

[30] Foreign Application Priority Data

Jun. 14, 1982 [JP] Japan ..... 57-88450[U]

[51] Int. Cl.[3] ..... F23D 13/12

[52] U.S. Cl. ..... 431/328; 431/329; 126/92 R

[58] Field of Search ..... 431/328, 326, 329; 126/92 AC, 92 R

[56] References Cited

U.S. PATENT DOCUMENTS

| | | | |
|---|---|---|---|
| 3,170,504 | 2/1965 | Lanning | 431/328 |
| 3,179,157 | 4/1965 | Partiot | 431/328 |
| 3,291,188 | 12/1966 | Partiot | 431/328 |
| 3,492,986 | 2/1970 | Partiot | 126/92 R |
| 3,558,251 | 1/1971 | Roca | 431/328 |
| 3,954,387 | 5/1976 | Cooper | 431/328 |
| 4,276,869 | 7/1981 | Kern | 126/92 AC |

FOREIGN PATENT DOCUMENTS

| | | | |
|---|---|---|---|
| 1477389 | 3/1967 | France | 431/328 |
| 1545693 | 10/1968 | France | 431/328 |
| 50036 | 4/1977 | Japan | 431/328 |
| 46361 | 4/1980 | Japan | 431/328 |

*Primary Examiner*—Samuel Scott
*Assistant Examiner*—Helen A. Odar
*Attorney, Agent, or Firm*—Nilsson Robbins Dalgarn Berliner Carson & Wurst

[57] ABSTRACT

An infrared gas burner plate of the type in which a sintered plate body formed of a heat resisting material is provided at its front surface with a plurality of grooves crossing one another to define a plurality of intercepting portions and a plurality of convex portions, the plate body being additionally provided with a plurality of burner holes therethrough between the front and rear surfaces thereof and distributed over the grooves and the convex portions. In accordance with the present invention, each of the intersecting groove portions is provided with a small convex portion having the burner hole at its center. More particularly, the small convex portions are frusto-conical in form.

2 Claims, 7 Drawing Figures

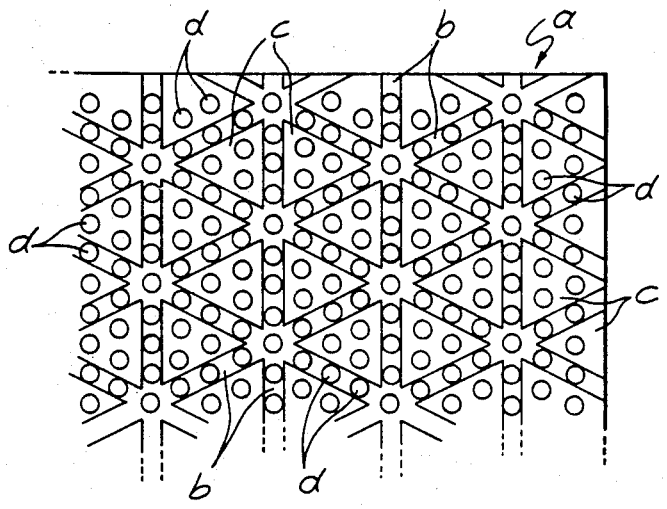
FIG. 1 -PRIOR ART
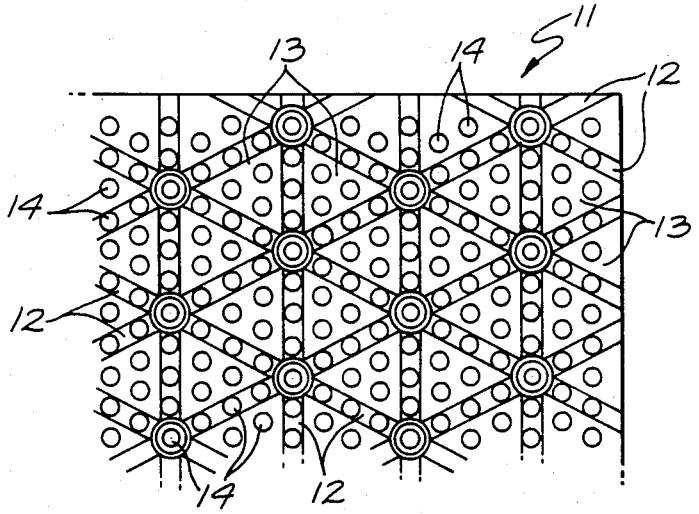
FIG. 2

INFRARED GAS BURNER PLATE

BACKGROUND AND SUMMARY OF THE INVENTION

This invention relates to an infrared gas burner plate used for a radiation type gas burner.

As for a burner plate of this kind, there has been hitherto known such a type as that shown in FIG. 1, for instance. A sintered plate body a composed chiefly of a heat resisting material such as ceramic or the like is provided at its front surface with a large number of grooves b crossing one another and a large number of convex portions c defined by these grooves b The plate body a is additionally provided with a large number of burner holes d piercing therethrough between the front and rear surfaces thereof and distributed over the grooves b and the convex portions c so that each of convex portions c may be made red-hot by being heated through the burner holes d made therein and the burner holes d in the surrounding grooves b around the same, and thereby the burner plate may be improved in radiation efficiency. This conventional type of burner plate, however, is such that the same is liable to be broken along any of the grooves b when subjected to a bending force. Moreover, it takes only about 40 seconds from ignition until the ignition can be confirmed visually from a red-hot condition of a corner portion of any of the convex portions c that is raised in temperature most easily. This makes it easy to more rapidly confirm the ignition as compared with a conventional flat plane type plate in which it takes one minute to confirm the ignition. However, it is desirable that this time be shorter so that use of a burner plate of this kind may be further facilitated.

This invention has for its object to provide a burner plate which has an improved bending strength, and in which the time necessary for confirmation of the ignition is shortened, and also has an improved radiation efficiency. More particularly, it is an object to provide a burner plate of the type wherein a sintered plate body composed chiefly of a heat resisting material such as ceramic or the like is provided at its front surface with a large number of grooves crossing one another and a large number of convex portions defined by these grooves, the plate body being additionally provided with a large number of burner holes piercing therethrough between the front and rear surfaces thereof and distributed over the grooves and the convex portions characterized in that each of the intersecting portions of these grooves is provided with a small convex portion having at its center the burner hole. In a preferred embodiment, each of the small convex portions is frustoconical in form.

BRIEF DESCRIPTION OF THE DRAWINGS

FIG. 1 is a plan view of a conventional burner plate;

FIG. 2 is a plan view of one example of a burner plate of this invention;

DETAILED DESCRIPTION

Figure 3:
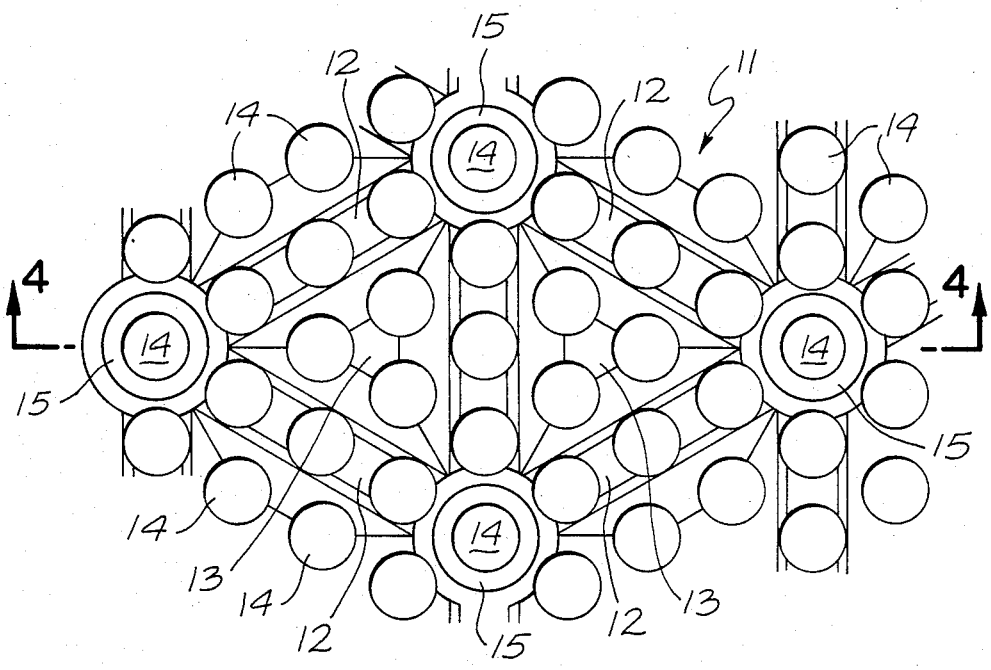
FIG. 3 is an enlarged plan view of the burner plate of FIG. 2.
Figure 4:
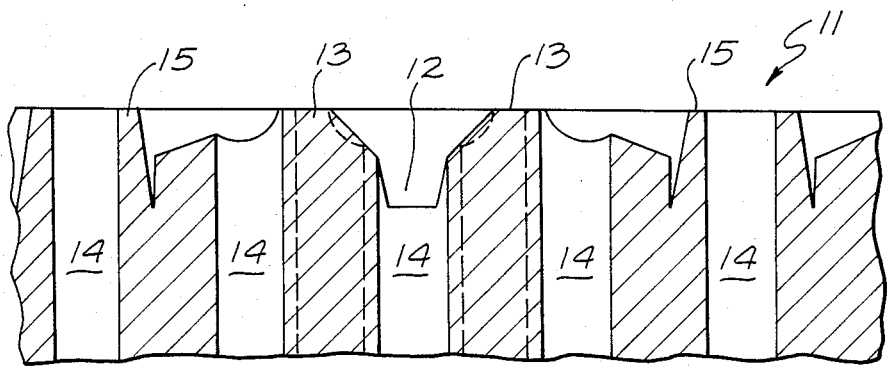
FIG. 4 is a sectional view taken along the line 4—4 in FIG. 3.

Embodiments of this invention will be explained with reference to the accompanying drawings. FIG. 1 has been referred to in the Background and Summary of the Invention. Referring to FIGS. 2 to 4 showing one example of the present invention, there is shown a sintered plate body 11 composed chiefly of a heat resisting material such as ceramic or the like, and which is provided at its front surface with a large number of grooves 12 crossing one another and a large number of convex portions 13 defined by the grooves 12. Additionally, the plate body 11 is provided with a large number of burner holes 14 piercing therethrough between the front and rear surfaces thereof and distributed over the grooves 12 and the convex portions 13. Each of the intersecting portions of the grooves 12 is provided with a small convex portion 15 having at its center one of the burner holes 14.

Figure 5:
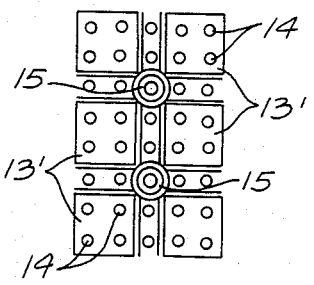
FIGS. 5 and 6 are plan view of alternative embodiments of this invention.
Figure 6:
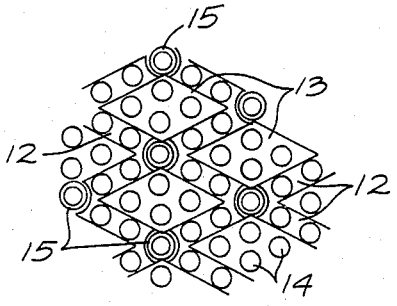

In the illustrated example, the grooves 12 are arranged to extend in three different directions so as to define the convex portions 13 each of which is in the form of a triangle. However, and referring to FIGS. 5 and 6, this invention is not limited thereto, and it is of course possible to arrange the grooves 12 so as to define convex portions 13' each in the form of a regular square as shown in FIG. 5 or convex portions 13'' each in the form of a lozenge as shown in FIG. 6, for instance.

Every small convex portion 15 is formed into a frustrum of a cone which is substantially, in its external circumferential contact with the corner portions of the triangular convex portions 13, disposed around the intersecting portion. As shown in FIG. 4, the small convex portions 15 are coplanar with the triangular convex portions 13.

The small convex portions 15 can be adjusted in red-hot degree by changing the height thereof.

A comparison test using the burner plate of this invention shown in FIGS. 2–4 and a conventional burner plate, shown in FIG. 1, has been made with the following results:

(i) Temperature rising characteristics

Figure 7:
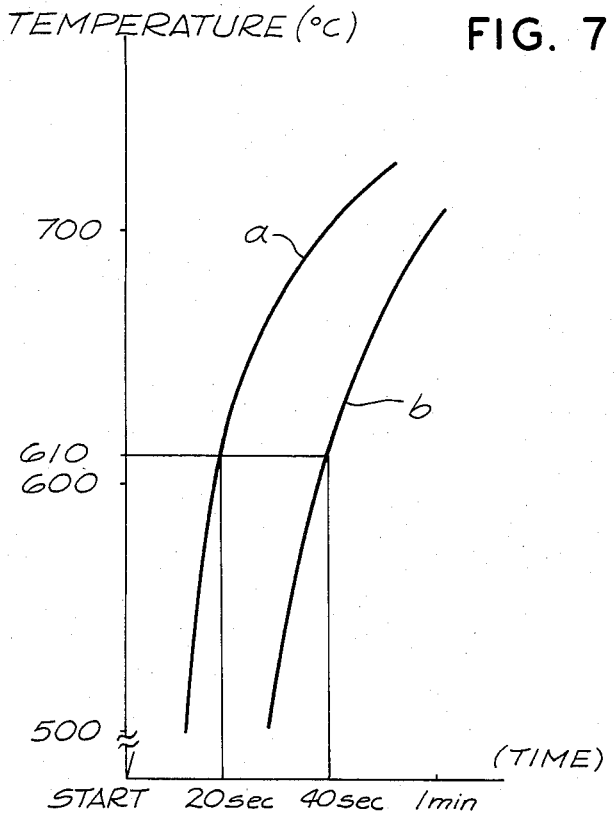
FIG. 7 is a diagram showing the temperature rising characteristics of a burner plate of this invention and of a conventional burner plate.

The small annular convex portions 5 are the easiest temperature-rising portions of the burner plate of this invention and the temperature rising characteristics thereof are as shown by curve "a" in FIG. 7. The easiest temperature-rising portions of the conventional burner plate are the corner portions of each convex portion "c" as described above, and the temperature-rising characteristics thereof are as shown by curve "b" in FIG. 7.

A time point at which the red-hot condition of the plate can be visually confirmed is when the surface temperature thereof reaches 610° C. It takes about 40 seconds from ignition until the red-hot condition can be visually confirmed in the case of the conventional burner plate, but it takes only about 20 seconds to confirm the ignition visually in the case of the burner plate of the present invention.

(ii) Average surface temperature and radiation efficiency of burner plate under steady burning condition The surface temperature is 910°–915° C. in the case of the burner plate of this invention, and is 900° C. in the case of the conventional burner plate. The radiation efficiency (according to a standardized measuring process—JIS. S2102, 7.7) is 28.5% in the case of the burner plate of the present invention, and is 25.0% in the case of the conventional burner plate.

(iii) Bending strength

Each burner plate is supported at both ends, a load is applied to the middle portion, and the bending strength is measured from the weight of this load when it is broken. The bending strength is 9 kg in the case of the conventional burner plate, but is 12–13 kg in the case of the burner plate of the present invention.

Thus, according to this invention, the grooves 12 are reinforced in bending strength with the small convex portions 15 and accordingly the burner plate can be increased in bending strength. Additionally the small convex portion 15 becomes red-hot rapidly or easily by burning through the center burner hole 14 made therein and the surrounding burner holes 14 made in the grooves 12. The burner plate is convenient to use in that visual confirmation of ignition by a user can be made in a comparatively short time, and it is also improved in radiation efficiency.

I claim:

1. In an infrared gas burner plate of the type in which a sintered plate body formed of a heat resisting material is provided at its front surface with a plurality of grooves crossing one another to define a plurality of intersecting portions and a plurality of first convex portions, the plate body being additionally provided with a plurality of burner holes therethrough between the front and rear surfaces thereof and distributed over the grooves and the first convex portions, characterized in that each of said intersecting groove portions is provided with a small convex portion having said burner hole at its center, said small convex portions being coplanar with said first convex portions.

2. An infrared gas burner plate of claim 1, wherein each of the small convex portions is frustoconical in form.

* * * * *